US011293649B2

(12) United States Patent
Crespo-Calero

(10) Patent No.: US 11,293,649 B2
(45) **Date of Patent: *Apr. 5, 2022**

(54) PROTECTIVE SEAL FOR COIL FINS OF AN AIR CONDITIONING CONDENSER UNIT

(71) Applicant: Omar Crespo-Calero, Boynton Beach, FL (US)

(72) Inventor: Omar Crespo-Calero, Boynton Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/266,434

(22) Filed: Feb. 4, 2019

(65) Prior Publication Data

US 2019/0178508 A1 Jun. 13, 2019

Related U.S. Application Data

(62) Division of application No. 15/225,324, filed on Aug. 1, 2016, now Pat. No. 10,197,295.

(60) Provisional application No. 62/198,863, filed on Jul. 30, 2015.

(51) Int. Cl.

| | |
|---|---|
| ***F24F 1/22*** | (2011.01) |
| ***F24F 13/20*** | (2006.01) |
| ***F24F 11/30*** | (2018.01) |

(52) U.S. Cl.

CPC ..... *F24F 1/22* (2013.01); *F24F 11/30* (2018.01); *F24F 13/20* (2013.01); *F24F 2013/202* (2013.01); *F24F 2221/02* (2013.01)

(58) Field of Classification Search

CPC .... F16J 15/3236; F16J 15/32; B60H 1/00507; A47C 21/08; A47C 15/00; A47C 15/005; A47C 15/008; A61G 7/0507; Y10S 5/946; F24F 1/16; F24F 1/22; F24F 11/30; F24F 13/20; F24F 2013/202; F24F 2221/02; F25B 30/00; F25B 29/00; H01F 27/08

USPC ..... 277/906; 220/378; 62/126, 158; 165/122, 125

See application file for complete search history.

(56) References Cited

U.S. PATENT DOCUMENTS

| | | | | | |
|---|---|---|---|---|---|
| 1,184,198 | A * | 5/1916 | Morison | F28F 9/002 | 165/71 |
| 2,478,137 | A * | 8/1949 | Timmer | F25B 39/04 | 62/508 |
| 3,620,407 | A * | 11/1971 | Wise | B65D 45/32 | 220/324 |
| 4,045,973 | A * | 9/1977 | Anderson | F25B 49/02 | 62/158 |
| 4,057,502 | A * | 11/1977 | Crumrine | B01D 35/30 | 210/440 |

(Continued)

*Primary Examiner* — Vishal A Patel
*Assistant Examiner* — L. Susmitha Koneru
(74) *Attorney, Agent, or Firm* — Malloy & Malloy, P.L.; Robert M. Downey

(57) ABSTRACT

A protective seal removably fits onto the top of coil fins of a condenser unit for an air conditioning system. The protective seal has a U-shaped cross-sectional configuration that allows the protective seal to fit over and completely cover the entire top edges of the coil fins and to extend partially down the front and rear sides of the coil fins to cover an upper portion of the front and rear sides of the coil fins. The protective seal is further structured to follow the contour of the top edges of the coil fins around all sides of the condenser unit to protect the top edges and the upper portion of the front and rear sides of the coil fins when the top lid of the condenser housing is both hinged open and closed.

2 Claims, 2 Drawing Sheets

(56) References Cited

U.S. PATENT DOCUMENTS 4,174,510 A * 11/1979 Smith ..... H01F 27/022 29/605
4,202,409 A * 5/1980 Cann ..... F24F 13/08 165/122
4,307,778 A * 12/1981 Tobin ..... F24F 1/18 165/125
4,394,111 A * 7/1983 Wiese ..... F24F 13/20 165/122
4,475,585 A * 10/1984 Hoeffken ..... F24F 13/20 165/122
4,672,817 A * 6/1987 Croce ..... F24F 1/022 239/145
4,802,405 A * 2/1989 Ichitani ..... B60H 1/00007 165/100
4,884,899 A * 12/1989 Schwartzman ..... F16C 17/10 384/100
4,893,478 A * 1/1990 Kruck ..... F25D 19/00 312/236
4,945,982 A * 8/1990 Das ..... F24F 1/06 165/125
5,066,194 A * 11/1991 Amr ..... F04D 29/547 415/223
5,237,831 A * 8/1993 Sikora ..... F24F 13/30 165/86
5,373,709 A * 12/1994 Tongu ..... F25B 15/02 62/476
5,744,211 A * 4/1998 Nakata ..... C08K 5/01 428/122
6,460,861 B1 * 10/2002 Castner ..... F16J 15/025 277/642
6,796,452 B2 * 9/2004 Petzitillo, Jr ..... B65D 88/126 220/378
8,234,734 B2 * 8/2012 Perry ..... A47D 15/00 5/663
8,267,156 B2 * 9/2012 Wang ..... F04D 29/526 165/58
8,479,451 B2 * 7/2013 Miyakawa ..... B60J 10/15 49/490.1
8,742,876 B2 * 6/2014 Chartouni ..... H01F 27/2876 336/55
8,893,438 B2 * 11/2014 Hamada ..... B60J 10/80 49/490.1
2002/0062648 A1 * 5/2002 Ghoshal ..... F28D 15/0233 62/3.7
2004/0065433 A1 * 4/2004 Meshenky ..... F28D 7/1692 165/153
2006/0081635 A1 * 4/2006 Matsutori ..... F16J 15/061 220/378
2008/0105410 A1 * 5/2008 Hwang ..... G06F 1/20 165/104.33
2009/0044927 A1 * 2/2009 Hwang ..... G06F 1/203 165/80.3
2010/0084123 A1 * 4/2010 Shishido ..... G06F 1/203 165/200
2013/0219942 A1 * 8/2013 Thomas ..... F25B 39/04 62/324.1
2013/0264033 A1 * 10/2013 Huang ..... G06F 1/203 165/104.26
2014/0232249 A1 * 8/2014 White ..... F24F 1/58 312/215
2016/0251130 A1 * 9/2016 Horikawa ..... F01N 13/1827 220/378
2017/0205084 A1 * 7/2017 Eskew ..... F24F 1/16
2020/0378694 A1 * 12/2020 Chehade ..... F28D 1/0443

* cited by examiner

PROTECTIVE SEAL FOR COIL FINS OF AN AIR CONDITIONING CONDENSER UNIT

BACKGROUND OF THE INVENTION

This Non-Provisional Patent Application is a Divisional Patent Application of co-pending Non-Provisional patent application Ser. No. 15/225,324, filed on Aug. 1, 2016, which is based on Provisional Patent Application No. 62/198,863, filed on Jul. 30, 2015.

FIELD OF THE INVENTION

The present invention relates to a condenser unit for an air conditioning system and, more particularly, to a protective seal that covers the top of coil fins of a condenser unit.

DISCUSSION OF THE RELATED ART

Most central air conditioning systems for residential and smaller commercial locations use a split system that has an air handler unit and a separate condenser unit. The air handler unit is typically located within the interior of a home or building, and the corresponding condenser unit is placed at an exterior location, such as a rooftop or ground slab. The condenser unit has a number of components, including a compressor, a condenser coil and a fan with a motor near a top of the unit. Coil fins surround the condenser coil. The components of the condenser unit are contained within a housing that has four sides, a floor and a top. The sides and top are vented to allow for airflow over the coil and out through the top as a result of operation of the exhaust fan, to thereby release heat from the refrigerant traveling through the condenser coil. Existing designs of condenser units are known to be difficult to access for purposes of service and repair. The poor access to components, as well as difficulty in removing and replacing components, requires considerable time when servicing and repairing condenser units. This not only frustrates service personnel, but also increases the cost to the customer. Moreover, the condenser coils are easily bent and damaged by impact with tools and other solid objects. When the top of the condenser housing is removed in order to gain access to the components, the top edges of the coil fins are frequently damaged.

SUMMARY OF THE INVENTION

The present invention is directed to a protective seal that removably fits onto the top of coil fins of a condenser unit for an air conditioning system. The protective seal has a U-shaped cross-sectional configuration that allows the protective seal to fit over and completely cover the entire top edges of the coil fins and to extend partially down the front and rear sides of the coil fins to cover an upper portion of the front and rear sides of the coil fins. The protective seal is further structured to follow the contour of the top edges of the coil fins around all sides of the condenser unit to protect the top edges and the upper portion of the front and rear sides of the coil fins when the top lid of the condenser housing is both hinged open and closed.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
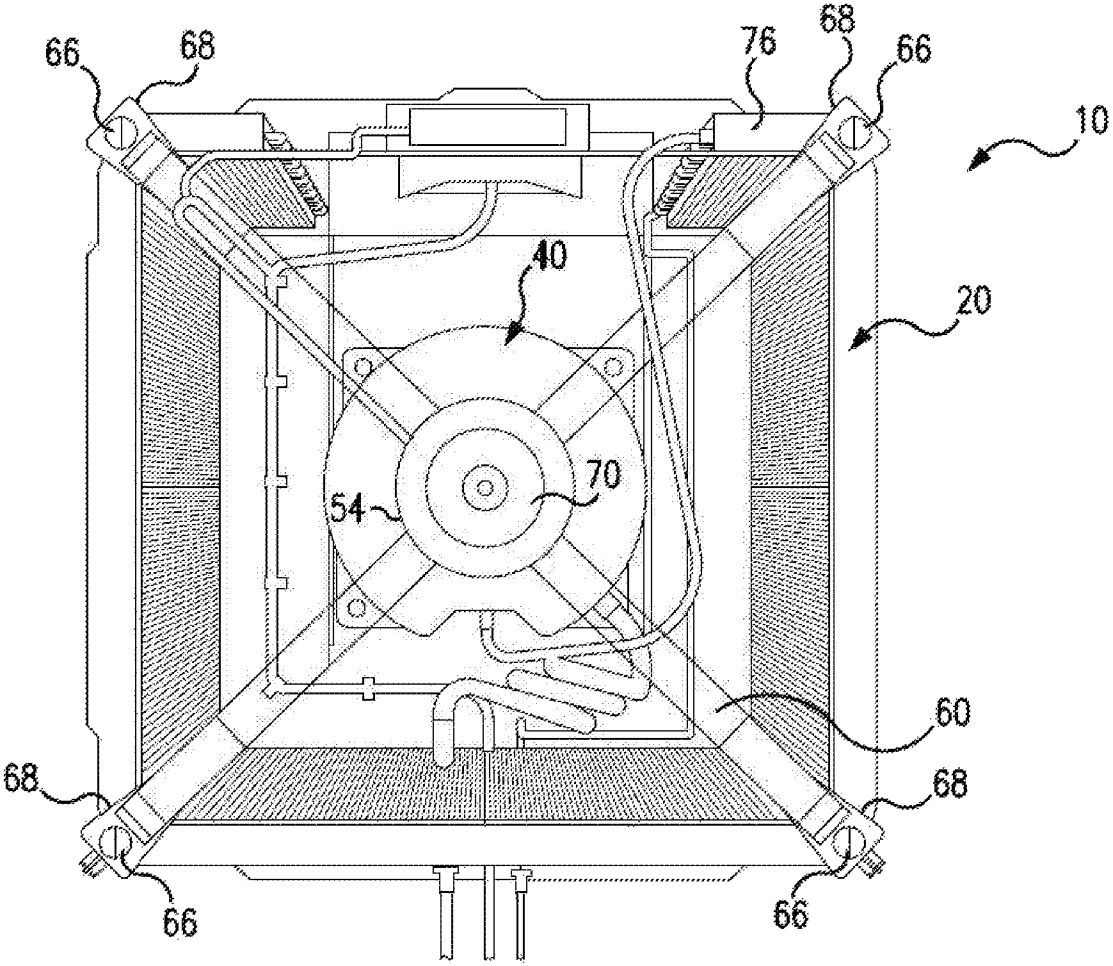
FIG. 1 is a top plan view of an air conditioner condenser unit with the lid removed and showing the protective seal fitted onto the top of the coil fins of the condenser unit.

The condenser unit of the present invention is shown throughout the several views of the drawings and is generally indicated as 10.

The condenser unit 10 includes a protective housing 20 that surrounds the condenser coil 30, coil fins 32, exhaust fan, compressor 40 and electrical components and connections. The housing 20 includes a top lid 22 with spring hinges that allow the top lid 22 to open and stay open by itself. The condenser unit lid 22 further includes a padlock hasp 50 that allows the lid 22 to be locked when the lid is closed, thereby preventing tampering. The lid 22 may also include an electromagnetic lock (EM) 52 to keep it closed, preventing the unit from being opened when it is powered as a safety measure.

Figure 2:
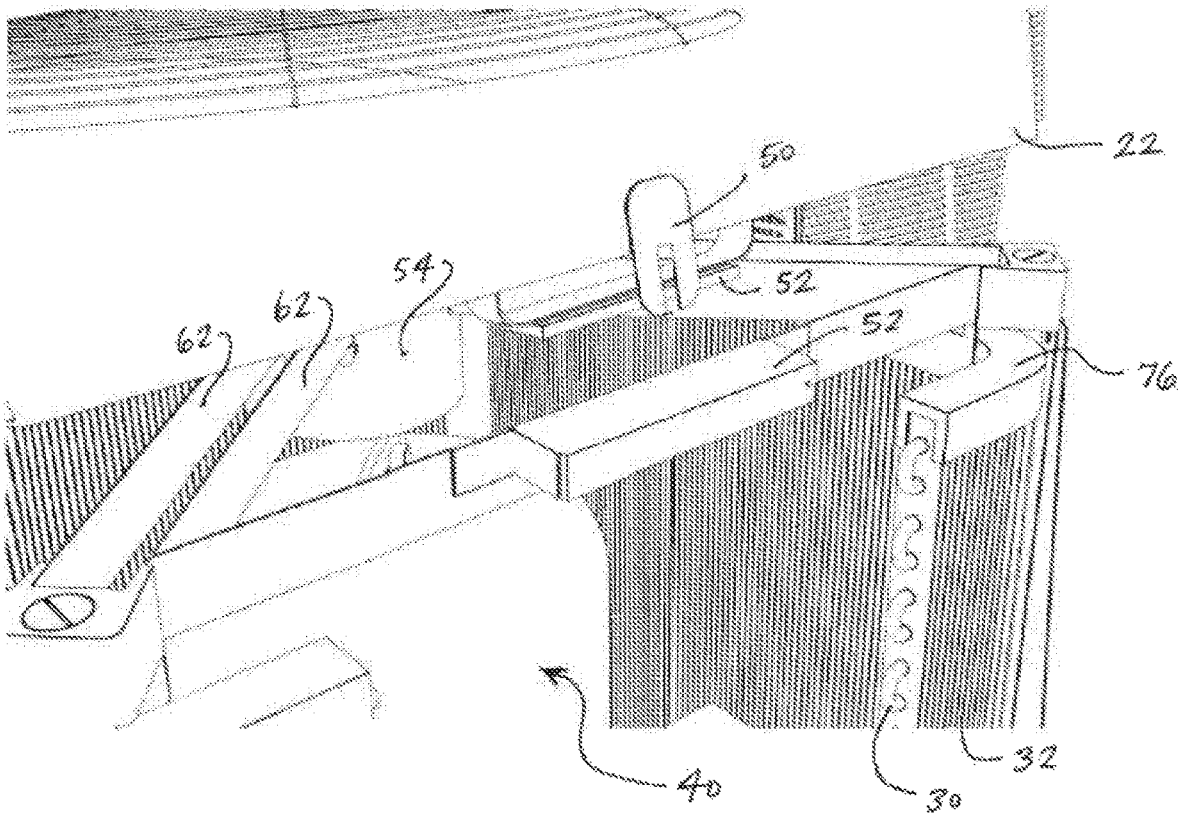
FIG. 2 is an isolated perspective view showing the lid of the condenser unit partially opened and the protective seal fitted over the top of the coil fins and extending partially down the front and rear sides of the coil fins.

A fan bracket includes struts 62 that support a motor socket 54. The bracket is easy to unlock with use of a flathead screwdriver. There are latches 66 at the four corners 68 of the condenser unit, and the fan bracket sits in all four corners with the EM lock facing the front. A rubber seal on an inside of a seal cap 70 prevents moisture from getting inside the fan motor. The coil fins 32 are protected by a removable molded rubber seal 76 that follows the contour of the top end of the coil fins 32. As seen in FIG. 2, the protective rubber seal 76 has a U-shaped cross-sectional configuration and is structured and disposed to fit over and completely cover the entire top edges of the coil fins 32. The U-shaped configuration allows the protective rubber seal 76 to extend partially down the front and rear sides of the coil fins 32 to protectively cover an upper portion of the front and rear sides of the coil fins 32. The protective rubber seal 76 is further structured and disposed to follow the contour of the top edges of the coil fins to protect the top edges and the upper portion of the front and rear sides of the coil fins when the top lid 22 of the condenser housing 20 is both hinged open and closed.

While the present invention has been shown and described in accordance with a preferred and practical embodiment thereof, it is recognized that departures from the instant disclosure are fully contemplated within the spirit and scope of the present invention which is not to be limited except as defined in the following claims.

What is claimed is:

1. A condenser unit for an air conditioning system comprising:

a compressor;

a condenser coil;

an exhaust fan including a fan motor and fan blade;

a condenser housing surrounding the compressor, the condenser coil and the exhaust fan, and said condenser housing including a base, a top lid and a plurality of vertical panels extending upwardly between the base and the top lid and defining side walls of the condenser housing;

a condenser fin arrangement surrounding the condenser coil and having a top end, and the condenser fin arrangement including a plurality of flat condenser fins extending vertically between the base and the top lid in spaced, parallel relation to each other, and the condenser fins including top edges, front edges and rear edges; and a removable protective rubber seal having a U-shaped cross-sectional configuration that fits over and completely covers the entire top edges of the condenser fins and the removable protective rubber seal extending partially down the front and rear edges of the condenser fins to cover an upper portion of the front and rear edges of the condenser fins, and the protective rubber seal being bendable to freely follow the contour of the top end of the condenser fin arrangement to allow for attachment and removal of the protective rubber seal over the top end of the condenser fin arrangement, and the removable protective rubber seal protecting the top edges and the upper portion of the front and rear edges of the condenser fins when the top lid of the condenser housing is both hinged open and closed.

2. The condenser unit as recited in claim 1 wherein the removable protective rubber seal is structured and disposed to conform to and follow a curved direction of the top end of the condenser fin arrangement.

* * * * *